United States Patent [19]

Misawa et al.

[11] Patent Number: 4,724,014

[45] Date of Patent: Feb. 9, 1988

[54] METHOD FOR COOLING A STEEL STRIP IN A CONTINUOUS ANNEALING FURNACE

[75] Inventors: Yasuo Misawa; Takeo Dazai; Tsutomu Haeno; Yoshio Saitoh; Masanori Shimada, all of Kimitsu, Japan

[73] Assignee: Nippon Steel Corporation, Tokyo, Japan

[21] Appl. No.: 816,988

[22] Filed: Jan. 9, 1986

Related U.S. Application Data

[63] Continuation of Ser. No. 618,471, Jun. 8, 1984, abandoned.

[30] Foreign Application Priority Data

Jun. 11, 1983 [JP] Japan ..... 58-104617

[51] Int. Cl.[4] ..... C21D 11/00

[52] U.S. Cl. ..... 148/128; 148/156

[58] Field of Search ..... 148/143, 142, 156, 120; 266/87.88, 90

[56] References Cited

U.S. PATENT DOCUMENTS

| | | | |
|---|---|---|---|
| 4,415,382 | 11/1983 | Gasicey et al. | 148/153 |
| 4,422,623 | 12/1983 | Kuroda et al. | 266/109 |

FOREIGN PATENT DOCUMENTS

| | | | |
|---|---|---|---|
| 56-10973 | 3/1981 | Japan . | |
| 56-41321 | 4/1981 | Japan . | |
| 23032 | 2/1982 | Japan | 266/109 |
| 26128 | 2/1982 | Japan | 266/102 |
| 41317 | 3/1982 | Japan | 266/102 |
| 57-116734 | 7/1982 | Japan . | |
| 57-49097 | 10/1982 | Japan . | |

*Primary Examiner*—Christopher W. Brody

[57] ABSTRACT

The present invention relates to a method for cooling a steel strip in a continuous-annealing furnace. Conventionally, the steel strip is cooled by a water medium and, thus, oxidation is inevitable. Recently developed roll cooling methods can prevent oxidation but are disadvantageous in that the steel strip is non-uniformly cooled as seen in its short width direction.

The present invention attains uniform cooling by means of feedback control, in which the blowing width of the gas-jet cooler (21) is controlled by detecting the sheet temperature distribution with a thermometer (24, 60).

3 Claims, 16 Drawing Figures

Fig. 10
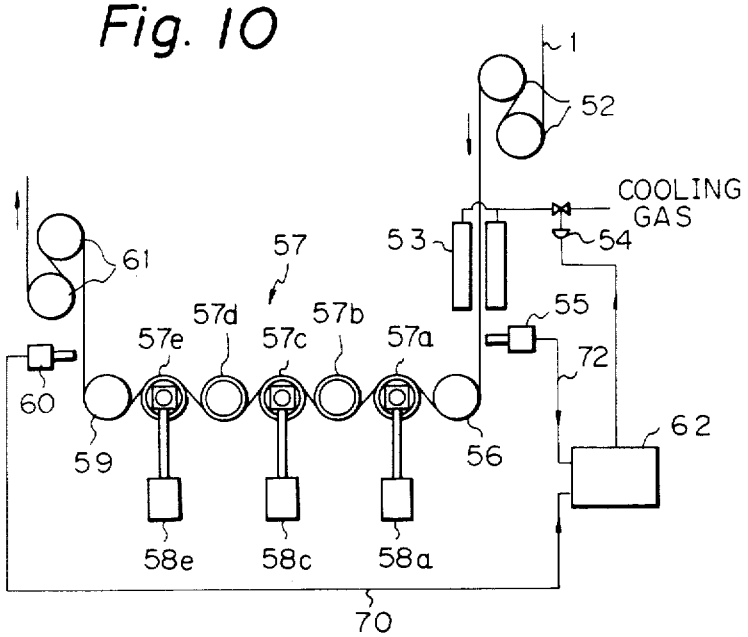
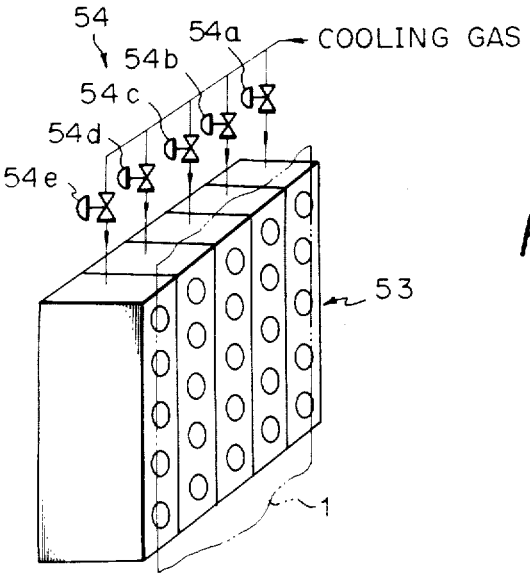
Fig. 11

METHOD FOR COOLING A STEEL STRIP IN A CONTINUOUS ANNEALING FURNACE

This application is a continuation of application Ser. No. 618,471, filed June 8, 1984 now abandoned.

BACKGROUND OF THE INVENTION

1. Field of the Invention

The present invention relates to a method for cooling a steel strip in a continuous-annealing furnace wherein, to cool the steel strip, the steel strip is brought into contact with a cooling roll having a structure which allows the passage of a cooling medium therethrough.

2. Description of the Prior Art

It is known to wind a steel strip, at a certain winding angle, on a roll(s) having a hollow aperture, the roll(s) being disposed in a continuous-annealing furnace, and to flow a cooling medium through the hollow aperture so as to cool the steel strip (c.f., for example, Nippon Kokan Technical Report No. 96, 1982, "Application of a Water-Cooled-Roll Technique to an NKK CAL Process"). This type of cooling involves an essentially unstable characteristic. That is, upon the generation of an unstable cooling state, the unstable cooling state is magnified. More specifically, if, with respect to one roll, superfluously one part of the steel strip is cooled compared to the other parts as seen in the traversal direction of the strip, thermal shrinkage of the one part occurs, and, hence, a greater tensional force is induced in the one part than in the other parts, which results in an increase in the contact pressure between the steel strip and the one roll or a succeeding roll and hence an increase in the heat transfer quantity. Thus, the phenomenon of cooling of the a superfluously cooled part of the steel strip is successively magnified or amplified. As a result, frequently the qualities of the product are nonuniform as seen in the short width direction of the steel strip and a serious shape failure which sometimes accompanies bending may occur. As one measure for preventing shape failure, the tensional force imparted to a steel strip being conveyed is enhanced so as to provide a uniform contact between the steel strip and the cooling roll. However, since the yield point of the steel strip is low at the high-temperature side of the cooling-temperature range, the tensional force imparted is restricted so as not to exceed the yield point, and, therefore, this measure cannot completely solve the above-mentioned problems. As is described above, the mechanism of roll-cooling is essentially unstable. A stable mechanism of roll-cooling is only attained by the provision of means for controlling the roll-cooling quantity as seen in the short width direction of a steel strip.

Various methods for controlling the roll-cooling quantity as seen in the short width direction of a steel strip have been disclosed. For example, Japanese examined patent publication No. 57-49097 discloses a controlling method in which the cooling-medium channel in the cooling roll is separated into a plurality of channels and the flow rate of the cooling medium in each channel is controlled as seen in the short width direction of a steel strip. However, satisfactory cooling cannot be expected in this disclosed method since the heat flow rate from the steel strip to the cooling roll is predominantly determined by the contact heat conductance at the contact portion of a steel strip and the cooling roll. Hence, the heat resistance in the cooling-medium channel is generally small.

According to another controlling method, i.e., the one disclosed in Japanese unexamined patent publication No. 57-116734, the cooling-medium channel is separated into a plurality of channels as seen in the short width direction, and the pressure of the cooling medium in each channel is varied to change the roll crown of the cooling roll. In this method, a high pressure is necessary, thereby making the investment cost enormous.

According to still another controlling method disclosed in Japanese unexamined patent publication No. 56-41321, a gas jet is blown from behind the cooling roll onto the edge portions of a steel strip, at which edge portions contact failure between the cooling roll and the steel strip is likely to occur, the edge portions additionally being cooled by the gas jet. However, since a portion of a steel strip where nonuniform contact between the cooling roll and the steel strip occurs is not limited to the edge portions, the disclosed method cannot attain a satisfactorily uniform cooling.

According to yet another controlling method disclosed in Japanese examined patent publication No. 56-10973, a plurality of gas-jet nozzles are disposed adjacent to the rear surface of the cooling roll in an attempt to make the cooling more uniform. The utility of this method, however, is poor because once a great nonuniformity in the tensional force distribution is generated in a steel strip which is wound around the cooling roll, an extremely strong gas jet is necessary to correct the tensional force distribution.

SUMMARY OF THE INVENTION

It is an object of the present invention to provide a method for uniformly cooling a steel strip while eliminating the disadvantages of the prior art.

The present invention proposes a method for cooling a steel strip wherein one or more cooling rolls are located in a continuous-annealing furnance and the steel strip is wound around the cooling roll(s) and is cooled by flowing a cooling medium through the cooling roll(s), characterized in that the temperature distribution of the steel strip along its short width direction is detected by a thermometer which is positioned at the outlet side of the last cooling roll, a gas-jet cooler for changing the temperature distribution of the steel strip along its short width direction is located at the inlet side of the first cooling roll, and the injection rate of the gas-jet cooler is varied at the inlet side on the basis of the temperature distribution along the short width direction detected by the thermometer at the outlet side. This method is hereinafter referred to as a feedback method.

In addition, the present invention proposes a method for cooling a steel strip wherein one or more cooling rolls are located in a continuous-annealing furnace and the steel strip is wound around the cooling roll(s) and is cooled by flowing a cooling medium through the cooling roll(s), characterized in that the gas flow of the gas-jet cooler for changing the temperature distribution of the steel strip along its short width direction, the cooler being located at the inlet side of the first cooling roll, is controlled by a signal of a cooling-plant outlet thermometer for detecting the temperature distribution of the steel strip along its short width direction, the thermometer being located at the outlet side of the last cooling roll, and by a signal of a cooling-plant inlet thermometer for detecting the temperature distribution of the steel strip along its short width direction, the thermometer being located at the inlet side of the first cooling roll. This method is hereinafter referred to as a feedback-feedfoward method.

An embodiment of the feedback method comprises, in the method for cooling a steel strip in a continuous-annealing furnace, the steps of:

(a) flowing a cooling medium through the hollow aperture of one cooling roll located in the continuous-annealing furnace or through the hollow aperture of a plurality of cooling rolls arranged in the continous-annealing furnace along the conveying direction of the steel strip;

(b) winding the steel strip around the one cooling roll or the plurality of cooling rolls and conveying it;

(c) in the case of one cooling roll, situating at the outlet side of the cooling roll a themometer for measuring the temperature distribution of steel strip along its short width direction and situating at the inlet side of the cooling roll a gas-jet cooler for changing the temperature distribution of the steel strip along its short width direction; and in the case of a plurality of cooling rolls, situating at the outlet side of the last cooling roll as seen in the conveying direction of the steel strip a thermometer for measuring the temperature distribution of the steel strip along its short width direction and situating at the inlet side of the first cooling roll as seen in the conveying direction of the steel strip a gas-jet cooler for changing the temperature distribution of the steel strip along its short width direction;

(d) measuring the temperature distribution of the steel strip along its short width direction by means of the thermometer in step (b);

(e) injecting gas by means of the gas-jet cooler along the short width direction in step (b); and (f) changing the injecting rate at step (e) on the basis of the temperature distribution measured at step (d).

An embodiment of the feedback-feedforward method comprises, in the method for cooling a steel strip in a continuous-annealing furnace, the steps of:

(a) flowing a cooling medium through the hollow aperture of one cooling roll located in the continuous-annealing furnace or through the hollow aperture of a plurality of cooling rolls arranged in the continuous-annealing furnace along the conveying direction of the steel strip;

(b) winding the steel strip around the one cooling roll or the plurality of cooling rolls and conveying it;

(c) in the case of one cooling roll, situating at the inlet side of the cooling roll a gas-jet cooler for changing the temperature distribution of the steel strip along its short width direction and, in the case of a plurality of cooling rolls, situating at the inlet side of the first cooling roll as seen in the conveying direction of the steel strip a gas-jet cooler for changing the temperature distribution of the steel strip along its short width direction;

(d) in the case of one cooling roll, situating one thermometer for measuring the temperature distribution of the steel strip along its short width direction at the outlet side of the cooling roll and situating another thermometer between the cooling roll and the gas-jet cooler at the inlet side; and, in the case of a plurality of cooling rolls, situating one thermometer for measuring the temperature distribution of the steel strip along its short width direction at the outlet side of the last cooling roll as seen in the conveying direction of the steel strip and situating another thermometer at the inlet side of the first cooling roll, this side being between the first cooling roll and the gas-jet cooler;

(e) measuring the temperature distribution of the steel strip along its short width direction by means of the thermometers and generating signals of the measured temperature in step (b);

(f) injecting gas by means of the gas-jet cooler along the short width direction in step (b); and (g) controlling the injecting rate at step (f) by using the signal from the thermometer for detecting the temperature at the inlet side and the signal from the thermometer for detecting the temperature at the outlet side.

According to an embodiment of the feedback control method and feedback-feedforward control method, the thermometer(s) generate(s) a signal indicating the temperature of the steel strip at its edge portions and at the central portion.

According to another embodiment thereof, the thermometer(s) is connected to an operational controller which calculates the deviation ($\Delta T$) of the sheet temperature as seen in the short width direction of the steel strip, and when the deviation ($\Delta T$) is approximately 20° C. or more, control of the gas-jet cooler is initiated

BRIEF DESCRIPTION OF THE DRAWINGS

FIG. 10 is a drawing of an entire cooling plant.

FIG. 11 is a detailed view of a gas-jet cooler for blowing controlling gas.

DESCRIPTION OF THE PREFERRED EMBODIMENTS

Figure 1:
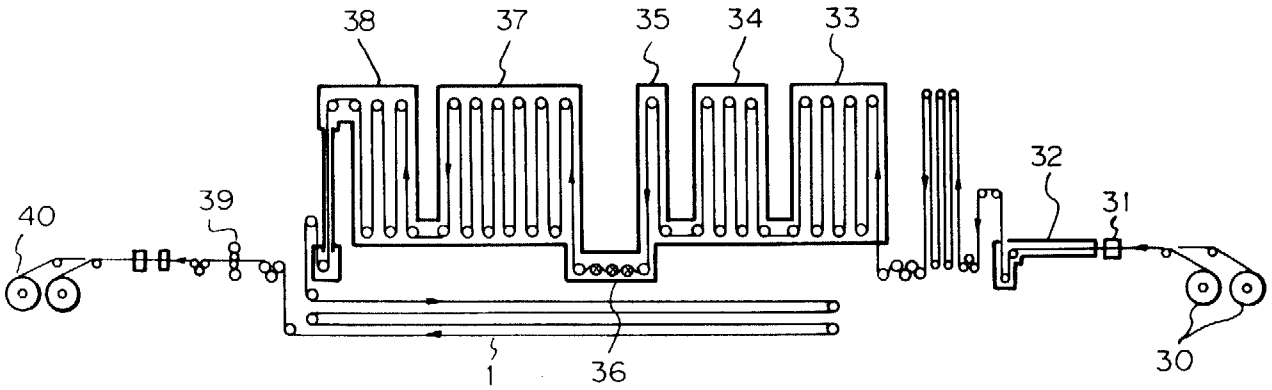
Fig. 1 PRIOR ART
FIG. 1 is a schematic drawing of a known continuous-annealing furnace in which the cooling method according to the present invention can be carried out.

In an embodiment of the method for cooling a steel strip in a continuous-annealing furnace according to the present invention, as is shown in FIG. 1, the steel strip 1 is conveyed continuously through a heating zone 33, a soaking zone 34, primary cooling zones 35 and 36, and, occasionally, an overaging zone 37 and a secondary cooling zone 38 of the continuous-annealing furnace, and roll-cooling of the heated steel strip 1 is carried out particularly in the primary cooling zone 36. The roll-cooling method according to the present invention can be carried out in the primary cooling zone 35, which is a slow-cooling zone, and/or the secondary cooling zone 38. Reference numeral 31 denotes a known welder for welding steel strips wound around the pay off rolls, and reference numeral 32 denotes a known electrolytic cleaning device. Reference numerals 39 and 40 denote a known skin pass mill and cooling reels, respectively. During roll-cooling, the conveyed steel strip 1 is brought into contact with at least one cooling roll and is turned around the at least one cooling roll along a predetermined conveying path, which is determined by the winding angle around the cooling-roll(s).

Figure 2:
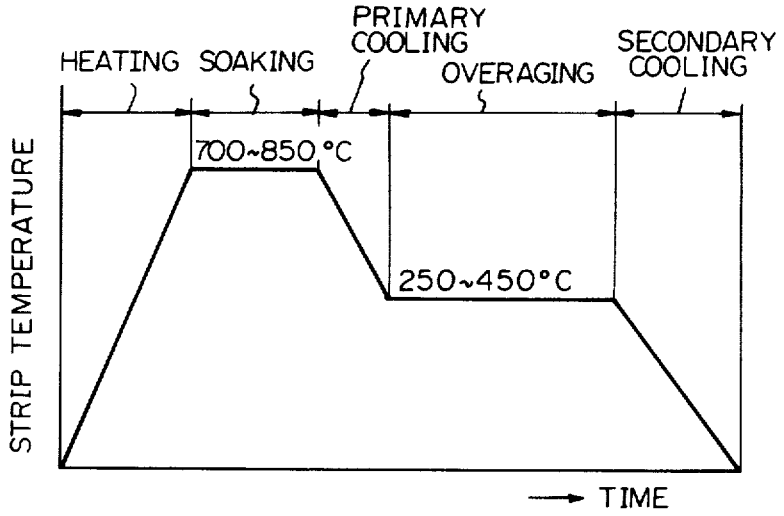
Fig. 2 PRIOR ART
FIG. 2 illustrates a continuous-annealing heat cycle in which a cold-rolled steel strip is conventionally cooled by gas-jet cooling.
Figure 3:
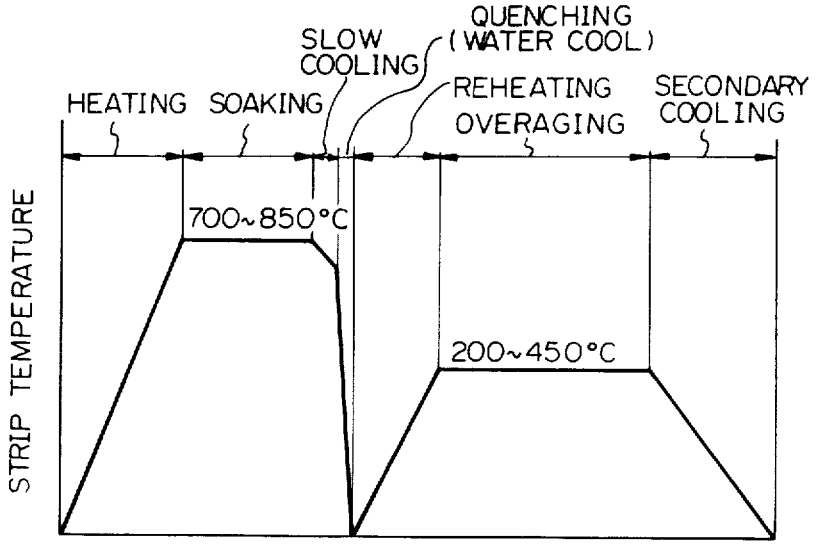
Fig. 3 PRIOR ART
FIG. 3 illustrates a continuous-annealing heat cycle in which a cold-rolled steel strip is conventionally cooled by water cooling.

In FIG. 2, the so-called stop-quenching heat cycle is illustrated. In the primary cooling step, gas-jet cooling, in which a cooling gas is directly blown onto the heated steel strip, is carried out. In FIG. 3, the so-called full-quenching heat cycle is illustrated. In the primary cooling step, the heated steel strip is cooled by spraying it with a gas jet and then immersing it in water.

Figure 4:
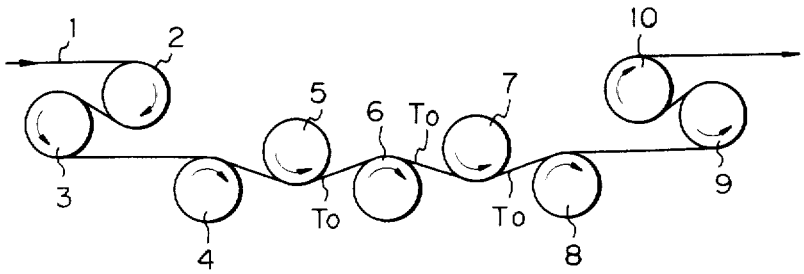
Fig. 4 PRIOR ART
FIG. 4 illustrates the arrrangement of the rolls in a cooling apparatus.

In FIG. 4, an example of the arrangement of the cooling rolls in a cooling zone, for example, a primary cooling zone of a continuous-annealing furnace, is illustrated. A predetermined tension is imparted, by means of bridle rolls 2, 3, 9, and 10, to the steel strip 1 which is to be cooled. Reference numerals 4 and 8 denote deflector rolls, and reference numerals 5, 6, and 7 denote cooling rolls. The number of cooling rolls 5, 6, and 7 is determined based on the capacity of the continuous-annealing furnace and the like. The steel strip 1 is brought into contact with each of the cooling rolls 5, 6, and 7 at a predetermined winding angle or surface area which is determined by the thickness of the steel strip 1, the processing speed, the temperature of the cooling medium, and the like and which is varied to attain a desired cooling rate.

The preferred embodiments of the feedback method are hereinafter described.

Figure 5:
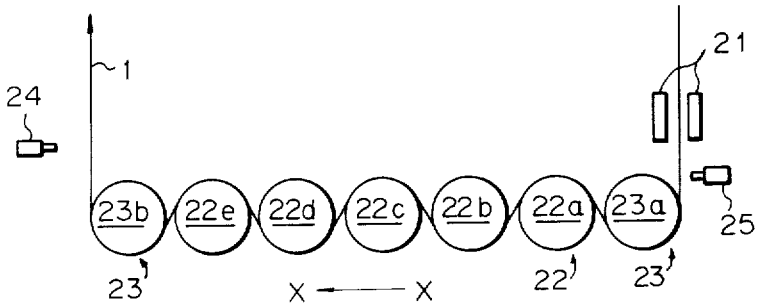
FIG. 5 illustrates an embodiment of the feedback method according to the present invention.

Referring to FIG. 5, a steel strip 1 is wound around the cooling rolls 22 which are arranged in a continuous-annealing furnace (not shown). The steel strip 1 is conveyed in the strip-conveying direction X—X, which is determined by the direction in which the cooling rolls 22 are arranged. A hollow aperture (not shown) is formed in the interior of the cooling rolls 22, and water, which is a cooling medium, is flown into the hollow aperture via the shaft by a known method. Reference numeral 23 denotes deflector rolls which may or may not have a cooling function.

According to the embodiment shown in FIG. 5, a gas-jet cooler 21 for blowing gas at a variable rate as seen in the short width direction is situated at the inlet side of the cooling roll **22*a*, where the steel strip 1 forms a free path, and a thermometer 24 for detecting the temperature distribution of the steel strip 1 along its short width direction is situated at the outlet side of the cooling roll 22*e***.

If it is necessary to measure the temperature distribution of the steel strip 1 along its short width direction at the inlet side of the cooling roll **22*a*, a thermometer 25 for detecting the temperature distribution of the steel strip 1 along its short width direction is situated between the gas-jet cooler 21 and the cooling roll 22*a***.

Figure 6:
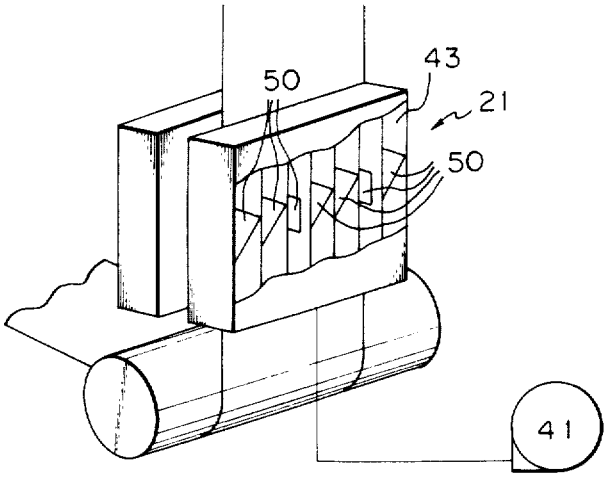
FIGS. 6 and 7 illustrate the structure of gas-jet coolers in which the blowing width is variable.
Figure 7:
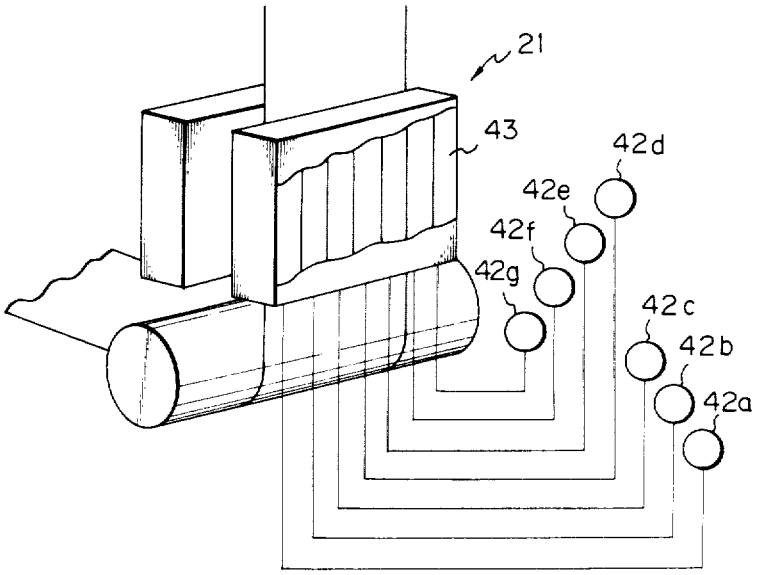

Referring to FIG. 6 and FIG. 7, advantageous embodiments for varying the gas flow over the short width direction are illustrated. In FIG. 6, the sturcture of a gas-jet cooler which enables the blowing width to be changed is shown. The gas-jet cooler 21 has a gas outlet which is subdivided into ducts 43, each duct having a closable damper 50. The gas from a blower 41 is controlled by opening or closing the dampers 50 and thereby controlling the airflow through each duct 43.

Alternatively, as is shown in FIG. 7, the blowers **42*a* through 42*g* may be provided for the subdivided ducts 43 of the gas outlet, respectively. In this case, the blowers 42*a* through 42*g* are selectively turned on or turned off to vary the airflow through the ducts 43**.

Figure 8:
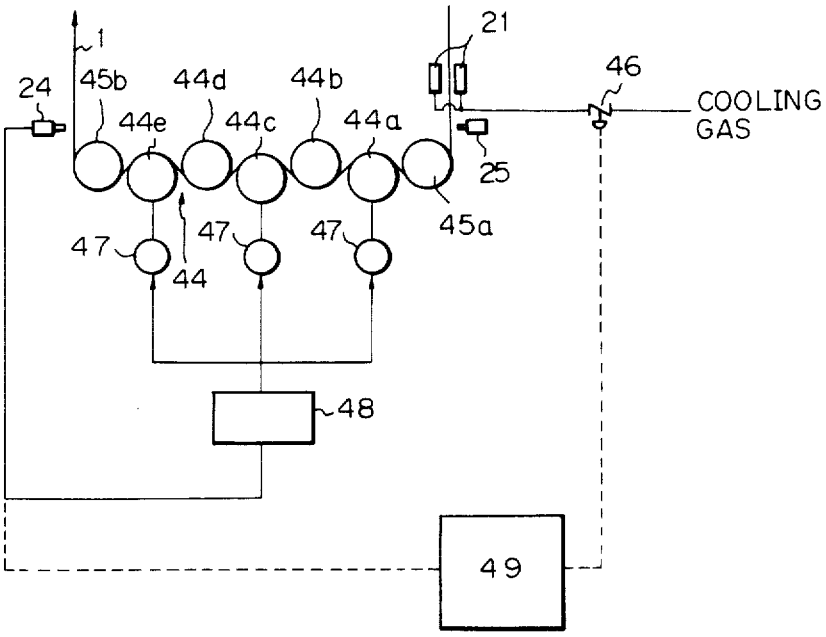
FIG. 8 shows the control system of the feedback method.

Referring to FIG. 8, which illustrates an example of the controlling system of a cooling plant according to the present invention, reference numeral 21 denotes a gas-jet cooler which allows the blowing width to vary and which is located at the inlet side of the first cooling roll **44*a*. Reference numeral 46 denotes a damper which controls the blowing rate and width. In the cooling system shown in FIG. 8, in order to provide a constant sheet temperature at the outlet side of the last cooling roll 44*e*, the sheet temperature is measured by a thermometer 24, the requisite contact length is calculated by an operational controller 48 on the basis of the measured temperature, and the cooling rolls 44 are shifted in the vertical direction of the drawing by means of the motors 47 for roll shift. Reference numerals 45*a* and 45*b*** denote deflector rolls.

Figure 9:
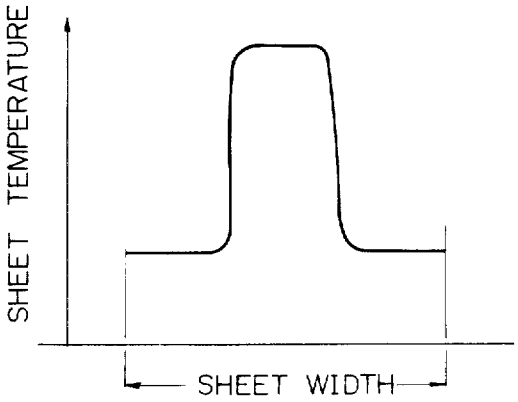
FIG. 9 illustrates an example of the temperature distribution of a steel strip along its short width direction at the outlet side of a cooling roll.

A controlling method for uniform cooling is carried out in the cooling apparatus as follows. The temperature distribution of the steel strip 1 in its short width direction is measured by the thermometer 24 located at the outlet side of the last cooling roll **44*e*. When the so-measured temperature distribution at the outlet side of the last cooling roll 44*e* is as shown in FIG. 9, i.e., when the central portion of the steel strip is not cooled but both edges are cooled, only the central portion of the steel strip is subjected to the blowing of cooling gas from the gas-jet cooler 21 which allows the blowing width to vary. This results in an improvement of the contact between the cooling rolls 44 and the central portion of the steel strip 1 and hence in the attainment of uniform cooling. Alternatively, when the central portion of the steel strip 1 is cooled but both edges are not cooled, the cooling gas is blown only onto the edges so as to improve the contact between the edges and the cooling rolls 44**.

If the cooling plant is provided, as is shown in the drawing, with the thermometer 25 situated at the inlet side of the first cooling roll **44*a* and with the thermometer 24 situated at the outlet side of the second cooling roll 44*e***, the following model equation of the temperature difference in the short width direction at the inlet side $\Delta T_{in}$ and the temperature difference in the short width direction at the outlet side $\Delta T_{out}$ is obtained:

$$\Delta T_{out} = f(\Delta T_{in}, v, t, Q),$$

wherein v is the line speed in meters per minute, t is the sheet thickness in mm, and Q is the gas blowing rate at $m^3$/minute.

The gas blowing rate Q, which is required for suppressing, within a tolerable range, the sheet temperature difference in terms of $\Delta T_{out}$ detected by the thermometer 24, is calculated and controlled by the operational controller 49, and the temperature difference in the short width direction at the inlet side of the first cooling roll 44a is controlled. This makes it possible to control the temperature difference in the short width direction at the outlet side of the last cooling roll 44e.

By means of the cooling plant described above, the temperature difference in the short width direction can be reduced to 20° C. at the maximum in the case of cooling the steel strip from 650° C. to 400° C. Conventionally, the above temperature difference is 150°C. at the maximum. According to the present invention, steel strips having uniform material qualities and an improved shape can therefore be produced. In addition, according to the present invention, nonuniform cooling can be prevented irregardless of the tensional force applied to the steel strip.

The preferred embodiments of the feedback-feed-forward method are hereinafter described.

In FIG. 10, which shows an overall view of a cooling plant according to the present invention, a steel strip 1 which is conveyed through a heating furnace (not shown) and a soaking furnace (not shown) into the cooling plant is first passed over bridle rolls 52, where the tension of the steel strip 1 is strengthened. This strengthening aims to increase as much as possible the tension of the steel strip 1 passing on the cooling rolls 57, thereby providing uniform contact between the steel strip 1 and the cooling rolls 57. The steel strip 1 then passes near the gas-jet cooler 53 for controlling the temperature distribution. The gas-jet cooler 53 is, as is shown in FIG. 11, subdivided into a plurality of members oriented in the short width direction of the steel strip. Each of the members is provided with one control valve 54 for controlling the gas flow therethrough. The steel strip 1, the temperature distribution of which in the short width direction is adjusted by the gas-jet cooler 53, arrives via the deflector roll 56 at the group of five cooling rolls 57 (57a through 57e). The cooling rolls 57b, 57d are stationary while the cooling rolls 57a, 57c, and 57e are vertically displaced by means of screw-down mechanisms 58a, 58c, and 58e for changing the winding angle of the steel strip 1 around the cooling rolls 57a, 57c, and 57e and hence controlling the strip temperature at the completion of cooling.

Upon the completion of cooling, the steel strip 1 is conveyed, via the deflector roll 59 and the bridle rolls 61 for reverting the tensional force to normal, into an overaging furnace (not shown).

The gas-jet cooler 53 for controlling the temperature distribution is installed at the inlet side of the first cooling roll 57a and is controlled as is described hereinbelow. Due to the installation position and manipulation of the gas-jet cooler 53, its controlling effect on the steel strip by the time the steel strip reaches the outlet side of the last cooling roll 57e is amplified a few times. That is, local cooling sequentially results in a local increase in the tensional force and in the promotion of further local cooling.

If a gas-jet cooler is installed between any of the cooling rolls 57a through 57e or at the outlet side of these cooling rolls, the above-described amplification can not be expected.

Figure 12:
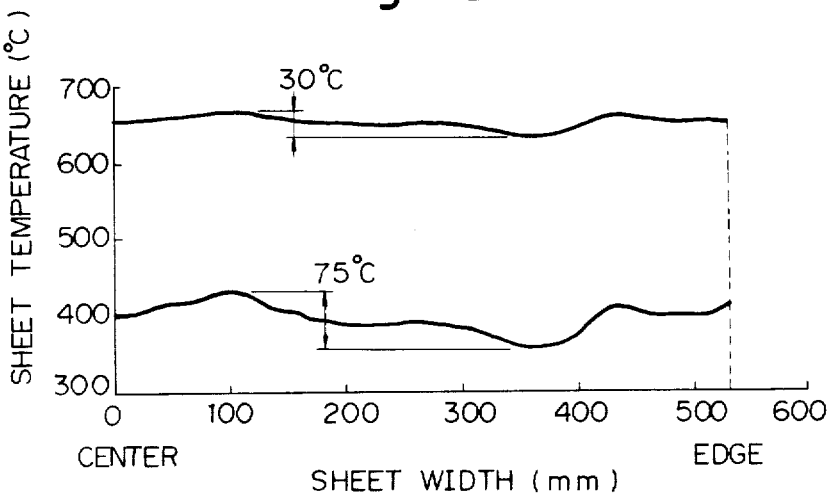
FIG. 12 illustrates the controllability of a gas-jet cooler for controlling the temperature distribution of a steel strip along its short width direction.

Referring to FIG. 12, an example of the controllability of a gas-jet cooler for controlling the temperature distribution in the case of five cooling rolls is shown.

The cooling conditions were as follows.

Line speed: 212 meters/minute
Diameter of cooling rolls: 1500 mm
Winding angle at each roll: 143°

The sheet temperature difference at the inlet side of the cooling rolls was approximately 30° C. and the sheet temperature difference at the outlet side of the cooling rolls was 75° C., indicating that the controlling effect of the gas-jet cooler was amplified 2.5 times.

An embodiment of the controlling system, in which a gas-jet cooler having the controllability described above, comprises:

(A) a feedback control loop 70 (FIG. 10) for controlling, on the basis of a signal of a thermometer 60 situated at the outlet side of the last cooling roll 57e, the airflow distribution of the gas-jet cooler 53 for temperature distribution control; and (B) a feedforward control loop 72 for controlling, on the basis of a signal of a thermometer 55 situated at the inlet side of the first cooling roll 57a, the gas flow distribution of the gas-jet cooler 53 for controlling the temperature distribution.

Figure 13:
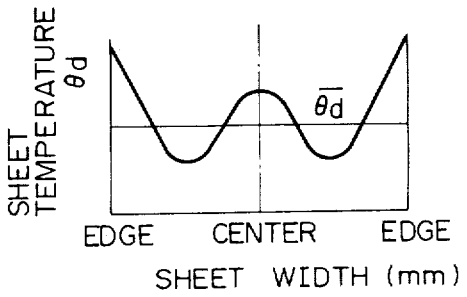
FIG. 13 shows an example of the temperature distribution of a steel strip along its short width direction.
Figure 14:
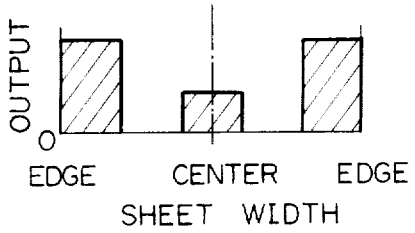
FIG. 14 illustrates the output of an operational controller for controlling a gas-jet cooler which controls the temperature distribution of a steel strip along its short width direction.

An example of feedback control is first described. The signal of the thermometer 60, i.e., the temperature distribution $\overline{\theta d}$ of the steel strip along its short width direction (FIG. 13), is input into the operational controller 62, and the operational controller 62 outputs, in accordance with a deviation of the above temperature distribution from the average value $\theta d$, the divergence of the control valves 54a–54e for controlling the cooling gas rate. The output of the operational controller 62 is shown in FIG. 14. The feedback control described above is considerably effective for lessening stationary deviation. However, in this feedback control, the control response of the control system must be determined taking into consideration such delay times as the conveying time of the steel strip from the control position (the position of the gas-jet cooler 53 for temperature distribution) to the sheet temperature-detecting position (the position of the thermometer 60) and the duration time for stabilizing the thermal crown of the cooling rolls. The thermal crown is as follows. The roll body of a cooling roll has such a length that the steel strip is brought into contact with the central portion of the roll body as seen in its axial direction. The temperature of this central portion is higher than the non-contact portion, with the result that a heat crown is formed on the roll body and, thus, contact between the steel strip and the roll body is impeded at both edges of the steel strip and a nonuniform temperature distribution is generated along the short width direction of the steel strip.

Feedback control can effectively control a disturbance having a considerably longer pitch than the above-described delay times but cannot stably control a short-term disturbance since hunting is generated. The delay times are dependent upon the specification of the cooling plant but are generally from 10 seconds to 20 seconds. The feedforward control loop 72, in which the signal of the thermometer 55 which is positioned directly behind the gas-jet cooler 53 is utilized for controlling the temperature distribution, improves such a low response of feedback control. According to feedforward control, the primary effect of the gas-jet cooler 53 for controlling the temperature distribution, i.e., the sheet temperature distribution at the inlet side of the first cooling roll 57a, can be immediately detected. If one has a previous knowledge of the relationship between this sheet temperature distribution and the sheet temperature distribution at the outlet side of the last cooling roll 57e, control with a quick response is possible.

The process gain G can be represented by using the sheet temperature distribution $\Delta\theta d$ in terms of the deviation from the average value $\theta d$ at the outlet side of the last cooling roll 57e and the sheet temperature distribution $\Delta\theta e$ at the inlet side of the first cooling roll 57a as follows.

$$G = \frac{\Delta\theta d}{\Delta\theta e} = f(\text{sheet thickness, tensional force, position in short width direction of sheet, speed})$$

Accordingly, when the gas flow rate of the gas-jet cooler 53 for controlling the temperature distribution is controlled by the operational controller 62 in order to attain the sheet temperature distribution $\Delta\theta e = \Delta\theta d/G$ at the inlet side, the sheet temeprature distribution at the outlet side can be made uniform. Evidently, a completely accurate process gain G cannot be determined in the practice, and, therefore, a completely uniform cooling cannot be attained only by means of feedforward control. Feedforward control is, therefore, used together with feedback control, thereby enabling a control with an excellent response and a low stationary deviation.

Conventionally, only a disturbance of pitch of 100 seconds or more can be stably controlled. Contrary to this, according to the present invention, a disturbance of pitch of 10 seconds or less can be stably controlled and the sheet temperature difference at the outlet side can be reduced to 20° C. or less.

According to the present invention as described above, the essentially unstable cooling process of roll-cooling can be so stabilized that the problems of nonuniform material qualities in the short width direction of the sheet and shape failure can be solved.

The roll-cooling is an epoch-making technique since it can attain a high cooling rate required for providing a steel strip with the requisite properties without oxidizing the steel strip, which oxidizing occurs in a conventional cooling method, in which a steel strip is brought into direct contact with a water medium. The only problem involved in roll-cooling in general is how to provide uniform cooling as seen in the short width direction of a steel strip. Since such a problem is solved by the present invention, the present invention contributes to the development of a technique for the continuous-annealing of a steel strip.

The present invention is now described by way of examples.

EXAMPLE 1

Figure 15:
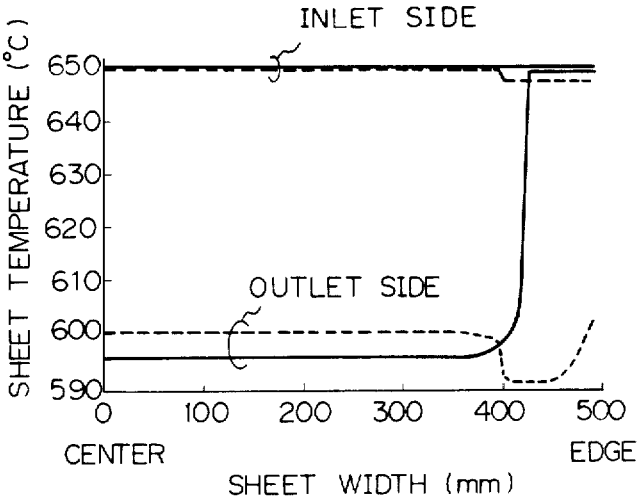
FIG. 15 illustrates the controllability of a gas-jet cooler.

In this example, the controllability of a gas-jet cooler was investigated, and the results shown in FIG. 15 were obtained. A steel strip 1000 mm in width and 0.85 mm in thickness (speed, 250 meters/minute) was wound around a single roll 1500 mm in diameter at a winding angle of 110°, and was cooled by the roll. The temperature of the steel strip at the inlet side of the cooling roll was 650° C.

A gas-jet cooler (GJC) was used to cool the steel strip at the inlet side, and the temperature distributions shown by the broken lines in FIG. 15 were obtained. Gas-jet cooling was applied to the 1000 mmwide edge portions of the steel strip, and cooling gas having a temperature of 100° C. and a thermal transfer coefficient of 50 kcal/m$^2$h° C. was blown onto the steel strip being conveyed at a cooling length of 1.5 m. As is apparent from FIG. 15, when the edge portions of the steel strip was cooled by approximately 3° C. at the inlet side of the cooling roll, the temperature at the outlet side decreased by approximately 9° C. and insufficient cooling at the edge portions was drastically improved.

When cooling by the gas-jet cooler was not carried out, the temperature distributions shown by the solid lines in FIG. 15 were obtained. There was failure between contact the steel strip and the cooling roll at the proximity of the edges thereof due to the thermal crown of the cooling roll, and the edges of the steel strip were not cooled at all.

EXAMPLE 2

The feedback control method was carried out.

A steel strip 0.85 mm in thickness and 1000 mm in width was conveyed at a line speed of 235 meters/minute and was cooled by five cooling rolls. The target temperature of the steel strip at the inlet side of the first cooling roll was 643° C.

Figure 16:
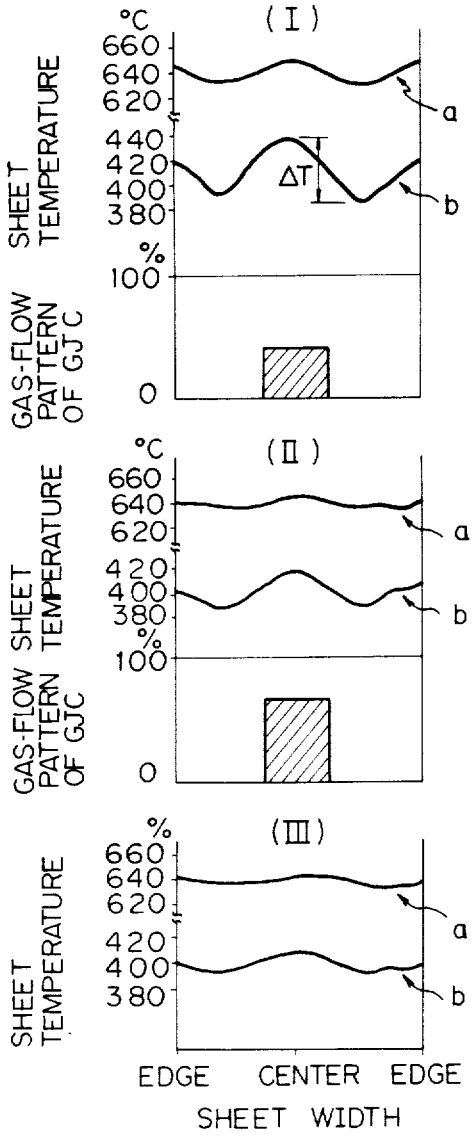
FIG. 16 illustrates the controlling method of Example 2.

Referring to FIG. 16, the symbol (I) indicates the initial cooling stage, in which the gas-jet cooler 21 (FIG. 8) for controlling the temperature distribution was not operated.

The temperatures of the steel strip 1 (FIG. 8) at the inlet side and at the outlet side are denoted by "a" and "b", respectively.

When the thermometer 24 detected that the deviation $\Delta T$ of the steel-strip temperature at the outlet side was 52° C., the divergence of the selected control valves was increased to 50% so that gas was selectively blown from the gas-jet cooler 21 onto the central high-temperature portion of the steel strip. This blowing was continued for approximately 30 seconds and then the second cooling stage (II) was obtained. In this stage, the temperature distribution at the outlet side was made uniform compared to that in the initial stage (I), but $\Delta T$ was 34° C. and still high. Subsequently, the divergence of the selected control valves was increased to 65% so that gas was selectively blown from the gas-jet cooler 21 onto the central high-temperature portion of the steel strip. This blowing was continued for 25 seconds so that the cooling stage (III), in which the deviation $\Delta T$ was 20° C., was obtained.

Accordingly, the deviation $\Delta T$ of 52° C. at the initial cooling stage (I) was decreased to 20° C. at the last cooling stage (III) by the feedback control method. The average sheet temperature of the steel strip in its short width direction at the inlet side was 643° C. at the third cooling stage.

We claim:

1. A method for cooling a steel strip in a continuous-annealing furnace, comprising the steps of:

(a) flowing a cooling medium through the hollow aperture of one cooling roll located in said continuous-annealing furnace or through the aperture of a plurality of cooling rolls arranged in said continuous-annealing furnace along a conveying direction of the steel strip;

(b) winding the steel strip around said one cooling roll or said plurality of cooling rolls and conveying it;

(c) in the case of one cooling roll, situating at the outlet side of said cooling roll a thermometer for measuring the temperture distribution of the steel strip along its short width direction and situating at the inlet side of said cooling roll, a gas-jet cooler having a gas outlet subdivided into a plurality of ducts arranged side-by-side in the short width direction of the steel strip for changing the temperature distribution of the steel strip along its short width direction; and in the case of a plurality of cooling rolls, situating at the outlet side of the last cooling roll as seen in the conveying direction of the steel strip a thermometer for measuring the temperature distribution of the steel strip along its short width direction and situating at the inlet side of the first cooling roll as seen in the conveying direction of the steel strip a gas-jet cooler having a gas outlet subdivided into a plurality of ducts arranged side-by-side in the short width direction of the steel strip for changing the temperature distribution of the steel strip along its short width direction;

(d) measuring the temperature distribution of the steel strip along its short width direction by means of the thermometer in step (c);

(e) injecting gas by means of said gas-jet cooler along the short width direction by controlling the gas flow in each of the ducts in step (c); and (f) controlling the temperature distribution along the short width direction of the portion of the steel strip contacting the first cooling roll as seen in the conveying direction of the steel strip by changing the injecting rate at step (e) on the basis of the temperature distribution measured at step (d).

2. A method according to claim 1 further including providing deflector rolls for imparting a tensional force to said steel strip at a location prior to the first cooling roll along the conveying direction of the steel strip and situating said gas jet cooler between said deflector rolls and the first cooling roll.

3. A method according to claim 1 further including:

calculating a deviation ($\Delta T$) of the temperature distribution measured across the short width direction of the strip;

initiating said controlling of the temperature distribution when the deviation ($\Delta T$) is approximately 20 ° C. or greater.

* * * * *

UNITED STATES PATENT AND TRADEMARK OFFICE

CERTIFICATE OF CORRECTION

PATENT NO. : 4,724,014

DATED : February 9, 1988

INVENTOR(S) : Y. Misawa, et al.

It is certified that error appears in the above-identified patent and that said Letters Patent is hereby corrected as shown below:

Column 3, line 8, change "aperture" to --apertures--.

Column 3, line 42, change "aperture" to --apertures--.

Column 5, line 51, change "flown" to --flowed--.

Column 7, line 16, change "feedback-feed-for-" to --feedback-feed for---.

Column 9, line 16, change "temeprature" to --temperature--.

Column 9, line 19, change "in the practice" to --in practice--.

Column 9, line 63, change "1000 mmwide" to --1000 mm wide--.

UNITED STATES PATENT AND TRADEMARK OFFICE

CERTIFICATE OF CORRECTION

PATENT NO. : 4,724,014

DATED : February 9, 1988

INVENTOR(S) : Y. Misawa, et al.

It is certified that error appears in the above-identified patent and that said Letters Patent is hereby corrected as shown below:

Column 10, line 1, change "was" to --were--.

Column 10, lines 7 and 8, change "between contact" to --of contact between--.

Signed and Sealed this

Fifth Day of July, 1988

*Attest:*

*Attesting Officer*

DONALD J. QUIGG

*Commissioner of Patents and Trademarks*